US009754470B2

(12) United States Patent
Ten Kate

(10) Patent No.: US 9,754,470 B2
(45) Date of Patent: Sep. 5, 2017

(54) FALL DETECTION SYSTEM AND A METHOD OF OPERATING A FALL DETECTION SYSTEM

(75) Inventor: Warner Rudolph Theophile Ten Kate, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 1034 days.

(21) Appl. No.: 13/124,404

(22) PCT Filed: Oct. 9, 2009

(86) PCT No.: PCT/IB2009/054445
§ 371 (c)(1),
(2), (4) Date: Apr. 15, 2011

(87) PCT Pub. No.: WO2010/044032
PCT Pub. Date: Apr. 22, 2010

(65) Prior Publication Data

US 2011/0201972 A1 Aug. 18, 2011

(30) Foreign Application Priority Data

Oct. 17, 2008 (EP) ..... 08166909

(51) Int. Cl.
*G08B 21/04* (2006.01)

(52) U.S. Cl.
CPC ..... *G08B 21/0446* (2013.01)

(58) Field of Classification Search
CPC .. A61B 5/1116–5/1117; A61B 5/1121–5/1122; G08B 21/043; G08B 21/0446
USPC ..... 600/587–595; 340/571.1, 571.7
See application file for complete search history.

(56) References Cited

U.S. PATENT DOCUMENTS

| | | | | |
|---|---|---|---|---|
| 7,028,547 | B2 * | 4/2006 | Shiratori et al. | 73/495 |
| 7,423,537 | B2 | 9/2008 | Bonnet et al. | |
| 2002/0008630 | A1 * | 1/2002 | Lehrman et al. | 340/669 |
| 2003/0158699 | A1 | 8/2003 | Townsend et al. | |
| 2003/0163287 | A1 * | 8/2003 | Vock et al. | 702/187 |
| 2005/0027216 | A1 * | 2/2005 | Guillemaud et al. | 600/595 |

(Continued)

FOREIGN PATENT DOCUMENTS

| | | | |
|---|---|---|---|
| EP | 1870037 | A1 * | 12/2007 |
| JP | 2002251681 | A | 9/2002 |

(Continued)

OTHER PUBLICATIONS

Bonnet et al: "A Magnetometer-Based Approach for Studying Human Movements"; IEEE Transactions on Biomedical Engineering, vol. 54. No. 7, Jul. 2007, pp. 1353-1355.

*Primary Examiner* — Rene Towa

(57) ABSTRACT

An alarm (35) provided by a fall detection system (2) may be caused by an accidental drop of the system. Therefore prior to issuing the alarm the fall detection system a confirmation is needed that a potential fall originates from a fall detection system that is worn by a user (4). A fall of a fall detection system that is not attached to a user is characterized by the occurrence of one or more full rotations of the system. Said rotations are identified by analyzing the output signal of a magnetometer, and by detecting a periodicity in said output signal. The fall detection system (2) provides the alarm in dependence of an identified absence of at least one full rotation.

19 Claims, 4 Drawing Sheets

(56) References Cited

U.S. PATENT DOCUMENTS

| | | | | |
|---|---|---|---|---|
| 2006/0049950 | A1 | 3/2006 | Lockhart | |
| 2006/0189902 | A1* | 8/2006 | Takai et al. | 600/595 |
| 2006/0279426 | A1* | 12/2006 | Bonnet et al. | 340/573.1 |
| 2007/0107068 | A1* | 5/2007 | Kelley et al. | 726/34 |
| 2008/0008462 | A1* | 1/2008 | Klinghult | 396/53 |
| 2008/0016962 | A1* | 1/2008 | Dwyer et al. | 73/504.02 |
| 2008/0129518 | A1* | 6/2008 | Carlton-Foss | 340/573.1 |
| 2008/0133277 | A1* | 6/2008 | Jang et al. | 705/3 |
| 2008/0182724 | A1 | 7/2008 | Guthrie | |
| 2010/0010771 | A1* | 1/2010 | Ikkink et al. | 702/141 |
| 2010/0121226 | A1* | 5/2010 | Ten Kate et al. | 600/595 |
| 2011/0201972 | A1 | 8/2011 | Ten | |

FOREIGN PATENT DOCUMENTS

| | | | |
|---|---|---|---|
| JP | 2002328134 | A | 11/2002 |
| JP | 2004023475 | A | 1/2004 |
| JP | 2005033697 | A | 2/2005 |
| JP | 2006277464 | A | 10/2006 |
| JP | 2008032521 | A | 2/2008 |
| WO | 2007148246 | | 12/2007 |

* cited by examiner

FALL DETECTION SYSTEM AND A METHOD OF OPERATING A FALL DETECTION SYSTEM

FIELD OF THE INVENTION

The invention relates to a fall detection system for detecting a fall of a person using said device. The invention further relates to a method of operating a fall detection system that provides an alarm in case of a detected fall of a person wearing said fall detection system.

BACKGROUND OF THE INVENTION

Fall detection systems are used to detect fall incidents of a user and report such incidents to a remote care provider who may take appropriate action. To that end, the user wears a detection system which comprises a sensor providing an output signal that is indicative of a movement of the user. For example the sensor may be an accelerometer wherein the output signal provides acceleration data indicating for example an impact which may be caused by the user hitting the ground due to a fall. To reduce a false alarm rate the fall detection system may comprise more than one sensor to differentiate between an accidental fall and normal activities such as walking, moving to a sitting position, etc.

US20060279426 discloses a procedure and system for detecting a person's fall. A person under supervision wears a sensor consisting of at least one accelerometer and a magnetometer oriented in his vertical direction. A fall event is picked up when a significant and rapid oscillation of the acceleration signal coincides with a shift in the ambient magnetic field between two levels.

SUMMARY OF THE INVENTION

It is an object of the invention to further reduce a false alarm rate of a fall detection system. This object is achieved with the fall detection system as defined in claim 1.

The invention is based on the insight that a percentage of the false alarms is caused by accidental drops of the fall detection systems. People using said device do often not permanently wear the fall detection system. For example the user of a fall detection system may not wear said fall detection system when he is going to bed. The fall detection system may be put on the table and accidently drop on the ground causing a false alarm. It may also get detached unintentionally due to different causes such as putting on/off a cardigan or coat or due to improper attachment of the fall detection system. To prevent this false alarm the system must be able to differentiate between an accidental drop of the system (while not being coupled to the user) and a fall of the user wearing said system. The invention is further based on the observation that unlike with the fall of a user wearing the fall detection system a drop of said system alone (meaning while not being detachably coupled to the user) quite commonly causes the system to rotate over 360 degrees or more. A fall detection system according to the invention comprises a magnetometer for monitoring the movement of a user. For example the orientation of the user with respect to the earth magnetic field may be monitored and a sudden change in said orientation may be indicative of a fall and result in an alarm. However the sudden change in the orientation may also have been caused by an accidental drop of the system. Therefore data on the absence or presence of at least one full rotation is provided enabling a differentiation between a fall (absence of one full rotation) and a drop (presence of one or more full rotations), which data may be used to reduce the false alarm rate, thereby achieving the object of the invention. An advantage of the magnetometer is that its output signal allows a more reliable determination of the absence or presence of a full rotation in comparison with an acceleration signal of an accelerometer. When an accelerometer rotates around itself, it will sense a centrifugal force next to the gravitational force. This centrifugal force may mask the gravitational force, especially for example in a free-fall situation, making it difficult to reliably detect the rotation.

In a further embodiment of the system provides the alarm only when no full rotation (or several full rotations) has been detected.

The accidental drop of the system may result in one or more rotations during the free fall before the system has hit the ground or an object. It has been observed that also after having hit the ground or the object the system will bounce and rotate one or more times. This observation is used to trigger a start of the analysis of the output signal of the magnetometer in response to an identified fall. Awaiting this trigger provides the advantage of reduced power consumption.

In a further embodiment of the system an accelerometer is included. The accelerometer provides a signal indicative of an acceleration to the analyzing means and only in case a predetermined threshold is exceeded the output signal of the magnetometer is analyzed to identify the absence or presence of one or more full rotations.

When the system accidently drops on the ground it is in most cases observed that the free fall ends with the system tumbling and rotating several times before coming to a rest. Based on this insight the system will rotate several times resulting in the output signal having a periodicity. This provides the advantage that in a further embodiment of the system an absence or presence of a full rotation is determined relatively simply by detecting a periodicity in said magnetometer's output signal.

The magnetometer may provide a 3D output signal representing a vector of the measured earth magnetic field with respect to the x-y-z detection axis of the magnetometer. A rotation axis of the system while rotating due to a drop is unknown and may have a different position in the x-y-z space each time the system drops. In a further embodiment of the system the periodicity in the output signal is detected by analyzing a periodicity in a 1D component of the 3D output signal, for example by detecting a periodicity in the earth magnetic field with respect to the x detection axis or the y detection axis or the z detection axis. In a further embodiment of the system the periodicity in the 1D component is determined using an autocorrelation function.

In a further embodiment the system further comprises an analog to digital converter, a memory and a processor. The analog to digital converter converts the output signal of the magnetometer to a plurality of digital codes, and these codes are stored in the memory. The processor determines using these digital codes the absence or presence of one or more full rotations. In case of the presence of one or more full rotations the system must not generate an alarm.

The invention further relates to a method of operating a fall detection system wherein the false alarm rate is reduced. This object is achieved by distinguishing between an accidental drop of the system and a fall of a user wearing the fall detection system. The method comprises a step of analyzing an output signal provided by a magnetometer to detect an absence or presence of at least one full rotation of the fall detection system. The system provides data on the detected absence or presence of at least one full rotation. This data may be used to judge whether an alarm provided by the system may be caused by an accidental drop.

In a further embodiment the step of generating an alarm is dependent on the results of the step of identifying a potential fall of the user and the result of the step of analyzing the magnetometer's output signal to detect the absence or presence of at least one rotation.

In a further embodiment of the method the steps of identifying a potential fall of the user and analyzing the magnetometer's output signal to detect the absence or presence of one or more full rotations are performed sequentially providing the advantage that the power consumption of the step of distinguishing between a drop and a fall is only spent in case of an identified potential fall. The potential fall may be a fall of the person wearing the system but may also be caused by an accidental drop of the system, for example from the table to the ground. For example the fall detection system may comprise an accelerometer. By analyzing an acceleration output signal of the accelerometer an impact caused by a fall or drop may be detected. Thus the identified potential fall may either be a fall of the user wearing the system or a drop of the system when not attached to said user. To prevent a false alarm the output signal of the magnetometer is analyzed to identify an absence or presence of one or more full rotations and both an alarm and data on the identified absence or presence of one or more full rotations are provided. In a further embodiment in case the presence of one or more full rotations has been identified no alarm is provided as the one or more rotations indicate an accidental drop.

As the system will spin several times when it drops in a further embodiment of the method the absence or presence of at least one rotation is obtained by determining a periodicity of the output signal of the magnetometer. This periodicity may be obtained by determining a periodicity in a 1D component of the 3D output signal of the magnetometer, for example by determining a periodicity in an x-component of a 3D x-y-z output signal, the x-y-z output signal representing a vector of the measured earth magnetic field with respect to the x-y-z detection axis of the magnetometer.

In a further embodiment of the method the periodicity of the output signal is determined using an autocorrelation function performed on a 1D component of the output signal of the magnetometer.

The invention further relates to the use of a determined periodicity in the output signal of a magnetometer to validate the alarm provided by the fall detection system. The determined periodicity indicates the presence of one or more full rotations, and the presence of these one or more full rotations indicate an accidental drop of the fall detection system. The fall detection system provides data on the determined absence or presence of at least one full rotation to facilitate a differentiation between a fall of the user and a drop of the (from the user) detached system. In a further embodiment the alarm may only be provided in response to a detected fall and the determined absence of at least one full rotation.

The invention further relates to a computer program product for use in a fall detection system such as for example a memory card or stick comprising program code. The program code, when executed on a processor, is adapted to detect a fall by a user of the fall detection system. The program code is further adapted to analyze an output signal provided by a magnetometer to detect an absence or presence of at least one full rotation of the fall detection system comprising the magnetometer, wherein the rotation is at least over 360 degrees. The program code is further adapted to provide data on the determined absence or presence of at least one full rotation. In a further embodiment the program code is further adapted to provide an alarm only in case of a detected fall and a determined absence of a full rotation.

BRIEF DESCRIPTION OF THE DRAWINGS

The invention will now be described, by way of example only, with reference to the following drawings, in which.

DETAILED DESCRIPTION OF THE EMBODIMENTS

Figure 1:
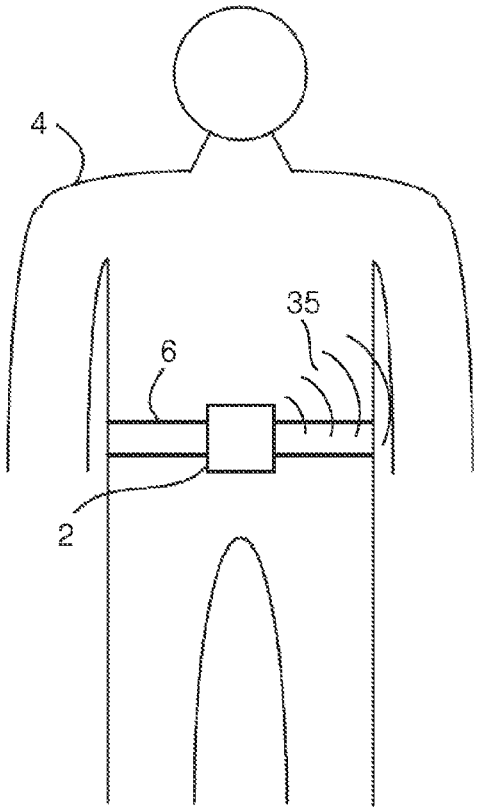
FIG. 1 shows a user wearing a fall detection system.

FIG. 1 shows a fall detection system 2 attached to a user 4 via a band or other attachment means 6. The fall detection system is preferably attached at the upper part of the user's body, such as around the waist, at the wrist, or as a pendant around the neck. If the fall detection system 2 detects a fall by the user 4 an alarm 35 can be broadcast (e.g. audible) from the fall detection system or it can be transmitted (e.g. wirelessly) to a call centre or assistance unit.

Fall detection systems are used to detect fall incidents of a user and report such incidents. Said systems may also be used by elderly people who want to stay independent and keep on living in their own home, but need assistance in case of a fall. Other applications of these systems are to secure safety of for example cash carriers, fire brigade, police, etc.

Figure 2:
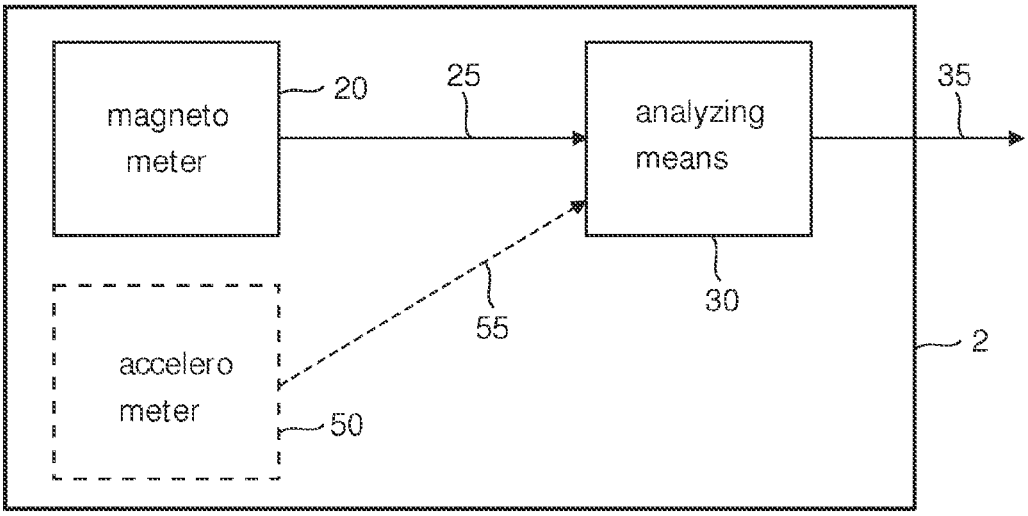
FIG. 2 shows a block diagram of the fall detection system.

FIG. 2 is a block diagram of a fall detection system 2 in accordance with the invention. The system comprises a magnetometer 20 that measures the direction and strength of the earth magnetic field with respect to a position of the magnetometer (and hence the user 4 when the fall detection system 2 comprising the magnetometer is attached to their body). The magnetometer generates an output signal 25 indicative of the measured magnetic field. For example the magnetometer 20 may comprise 3 sensors positioned perpendicular with respect to each other thereby enabling the measurement of the earth magnetic field (which is a vector) in an x-y-z space. The output signal 25 provided by the magnetometer comprises the measured strength in an x direction, measured by an x-sensor, in an y direction, measured by an y-sensor and in the z-direction, measured by a z-sensor. The analyzing means 30 process the output signal 25 to determine if the user 4 has fallen, and provide an alarm 35 (using transmitter and or receiver circuitry comprised in the system 2) for summoning help in the event the user 4 has fallen. A fall of a person is for example characterized by a sudden change in orientation followed by a period of little or no change in orientation while the user 4 lies on the ground. Said changes in orientation are detected by analyzing the output signal 25 provided by the magnetometer 20. A differential measurement, i.e. comparing orientation at two time instants, will make the detection of the fall by the analyzing means 30 independent of the actual attitude of the magnetometer 20 with respect to the body of the user 4 at the moment of the fall.

In some embodiments, the fall detection system 2 can further comprise one or more other sensors 50 that detect characteristics of movement of the user 4 (other than orientation) and that generate corresponding signals 55. These signals can then be used by the analyzing means 30 in combination with the output signal 25 of the magnetometer to determine with an increased reliability (resulting in a decreased false alarm rate) if the user has fallen. The one or more sensors 50 can comprise an accelerometer, a gyroscope, altimeter and/or any other suitable sensor. For example the sensor 50 may be an accelerometer. Falls are also often characterized by a large change of acceleration in the vertical direction, followed by a period of little or no activity represented by a period of relatively constant acceleration (this constant acceleration will usually be zero or gravity, depending on the type of accelerometer used).

To further decrease the false alarm rate the analyzing means 30 may monitor a period of inactivity after a sudden change in orientation and/or a large change in acceleration. Only in case the period exceeds a predetermined threshold a fall requiring help has happened requiring the issuing of an alarm 35.

A further cause of false alarm is an accidental drop of the fall detection system 2 while not being worn by the user. For example when the user is taking a bath the fall detection system 2 may be detached. This detached fall detection system may be dropped and cause a false alarm. A detached fall detection system has a fall characteristic that differs from a fall characteristic of a user wearing a fall detection system. Therefore to prevent a false alarm caused by an accidental drop the signals of the sensors 20, 50 comprised in the system 2 are analyzed to detect whether an accidental drop of the detached system or a fall of the user wearing the system has occurred. One of the differences between said fall characteristics is that a detached system is very likely to rotate one or more times when it is dropped. Although the axis of rotation is not known a priori a rotation as such can be detected with sensors such as an accelerometer, a gyroscope or a magnetometer.

As the fall detection system 2 will be battery powered and replacement of batteries may be a difficult task for some users the power consumption of all electronic circuits in the system should be minimized to get an acceptable time in which the system needs no service (for replacing the battery). Therefore the gyroscope is a less preferred sensor to be used leaving both the accelerometer and the magnetometer for detecting the at least one full rotation.

When the fall detection system comprising an accelerometer rotates during drop around itself, it will sense a centrifugal force, next to the gravitational force. From a view point of the sensor the centrifugal force will be approximately constant and the gravitational force will appear as rotating. The centrifugal force introduces a "DC" component in the acceleration signal provided by the accelerometer whereas the gravitational force is observed as an "AC" component when the system is rotating during a drop. The analyzing means 30 may detect a full rotation of the system by detecting the "AC" component in the acceleration signal. To enable the detection of the "AC" component the analyzing means may comprise a high pass filter to suppress the "DC" component. Experiments have shown that the cut-off frequency of the high pass filter may be typically at 0.6 Hz. A disadvantage of the use of the accelerometer for rotation detection is that rotation is not reliably detected. For example during a free fall condition the gravitational force sensed by the accelerometer may be zero, or close to zero making it difficult to detect a full rotation. Therefore in a preferred embodiment of the system a magnetometer is used to determine the absence or presence of at least one full rotation of the system (a full rotation is a rotation over at least 360 degrees) and is an alarm only provided in response to signals provided by the sensors indicating a potential fall, and a determined absence of one or more one full rotations.

A further difference between the fall characteristics of a detached system and the fall characteristic of a person wearing a fall detection system is that the detached system is also very likely to rotate one or more times after it has bumped into the ground after an accidental drop and tumbles. This characteristic provides a further possibility to reduce battery power consumption. In an embodiment of the fall detection system the output signal of the magnetometer are analyzed to identify the absence or presence of at least one full rotation in response to analysis of signals provided by the one or more sensors indicating a potential fall. A fall detection system 2 according to the invention comprises an accelerometer 50 and a magnetometer 20, both coupled to the analyzing means 30. The analyzing means 30 analyze a signal 55 provided by the accelerometer 50 and compare the signal 55 with a threshold. When the signal is larger than the threshold a potential fall may have occurred and the analyzing means analyze the output signal 25 provided by the magnetometer to identify the absence or presence of at least one full rotation. In case one or more full rotations are detected the potential fall is identified as an accidental drop and no alarm needs to be provided. However when no full rotation is detected the potential fall is identified as a fall of a user wearing said fall detection system and an alarm is issued.

Figure 3:
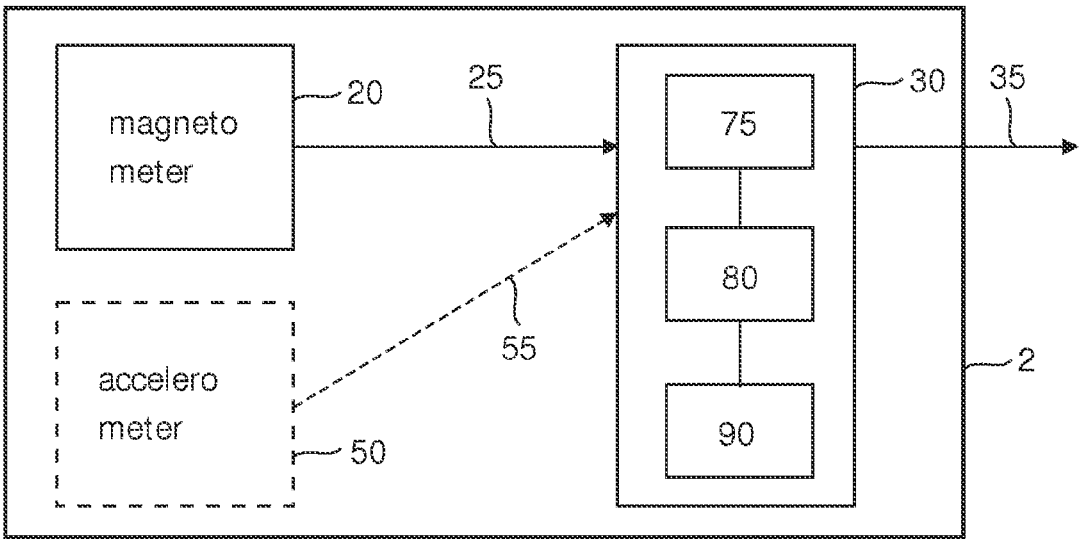
FIG. 3 shows a block diagram of a further fall detection system.

FIG. 3 shows a block diagram of a further fall detection system 2 in accordance with the invention. In an embodiment of the system the analyzing means 30 comprise an analog to digital (AD) converter 75 coupled to the magnetometer 20 and or the accelerometer 50. The AD converter 75 converts the output signal 25 and the acceleration signal 55 to a plurality of digital codes which are stored in a memory 80. The stored data is retrieved from the memory by a processor 90 and analyzed. In case of an identified fall the alarm 35 is triggered. The processor may execute a program code which is also stored in said memory 90 or may be provided on a further memory such as for example a memory card. The program code comprises for example an algorithm that, when executed on the processor 90, analyzes the output signal 25 provided by the magnetometer 20 to detect the absence or presence of at least one full rotation of the fall detection system 2 comprising the magnetometer.

Figure 4:
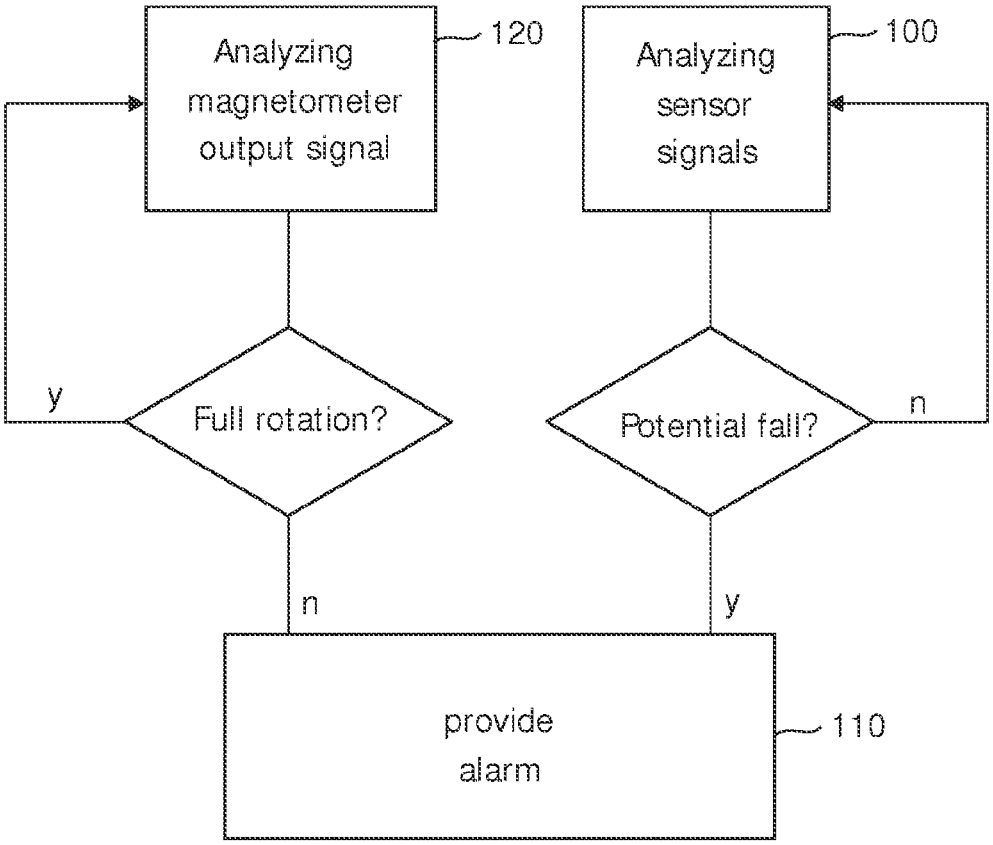
FIG. 4 is a flow chart illustrating a method in accordance with the invention.

FIG. 4 shows a flow chart that illustrates a method in accordance with the invention. The method comprises the steps of analyzing one or more sensor signals 100 to detect a potential fall, analyzing a magnetometers output signal 120 to determine the absence or presence of one or more full rotations and providing an alarm 110 in case of a detected potential fall and a detected absence of a full rotation. In case of one or more full rotations the detected potential fall was actually caused by a drop of the fall detect system while it was not being attached to the user. The step of analyzing one or more sensor signals 100 to detect a potential fall and the step of analyzing a magnetometer output signal 120 to determine the absence of a full rotation may be performed in parallel. The determining of the absence or presence of one or more rotation is preferably performed using the output signal provided by a magnetometer, but may also be realized by using a signal of an other sensor such as a gyroscope or an accelerometer.

Figure 5:
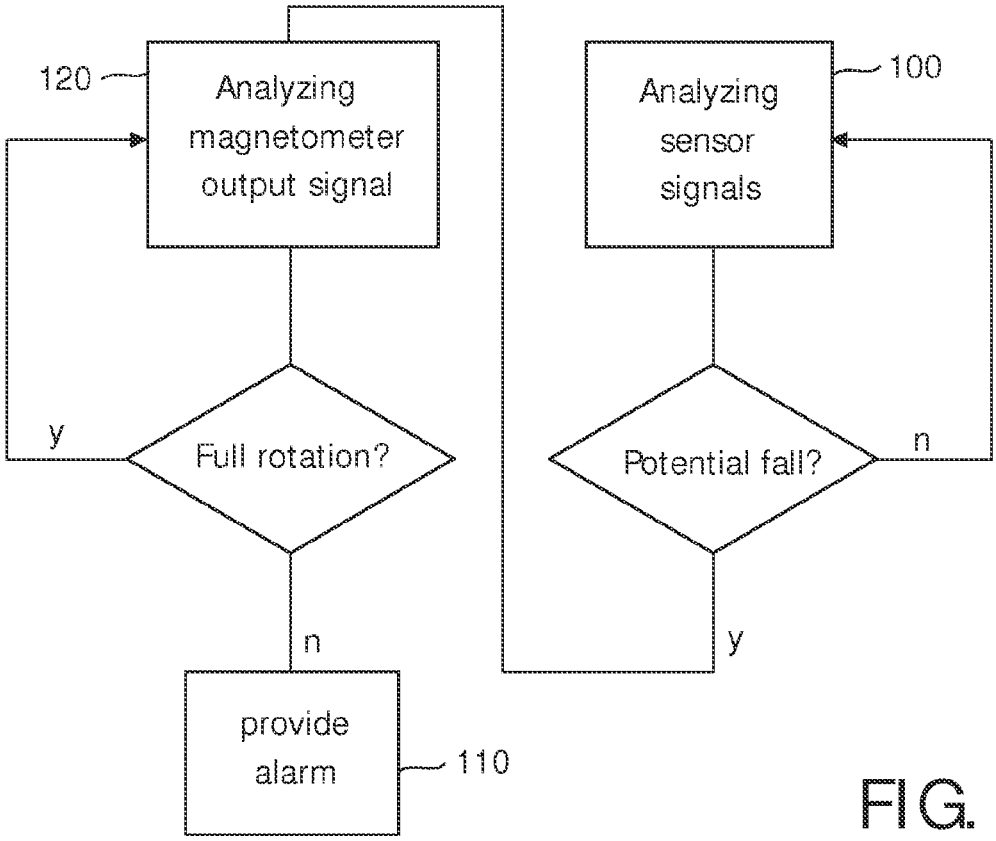
FIG. 5 is a flow chart illustrating a further method in accordance with the invention.

FIG. 5 shows a further flow chart that illustrates a further method in accordance with the invention. To save on power consumption the step of analyzing the output signal of the magnetometer 120 to determine the absence or presence of a full rotation is made dependent on a detected potential fall. When a potential fall is detected, said fall may actually be caused by an accidental drop of the system. Therefore next the step of analyzing the magnetometers output signal 120 to detect the absence of a full rotation is performed. In case of a detected absence of a full rotation the potential fall relates to a fall of a user wearing the fall detection system, and therefore next the step of providing an alarm 110 is performed. A potential fall may be detected by analyzing the signal provided by an accelerometer or by analyzing the signals of a combination of sensors.

Figure 6:
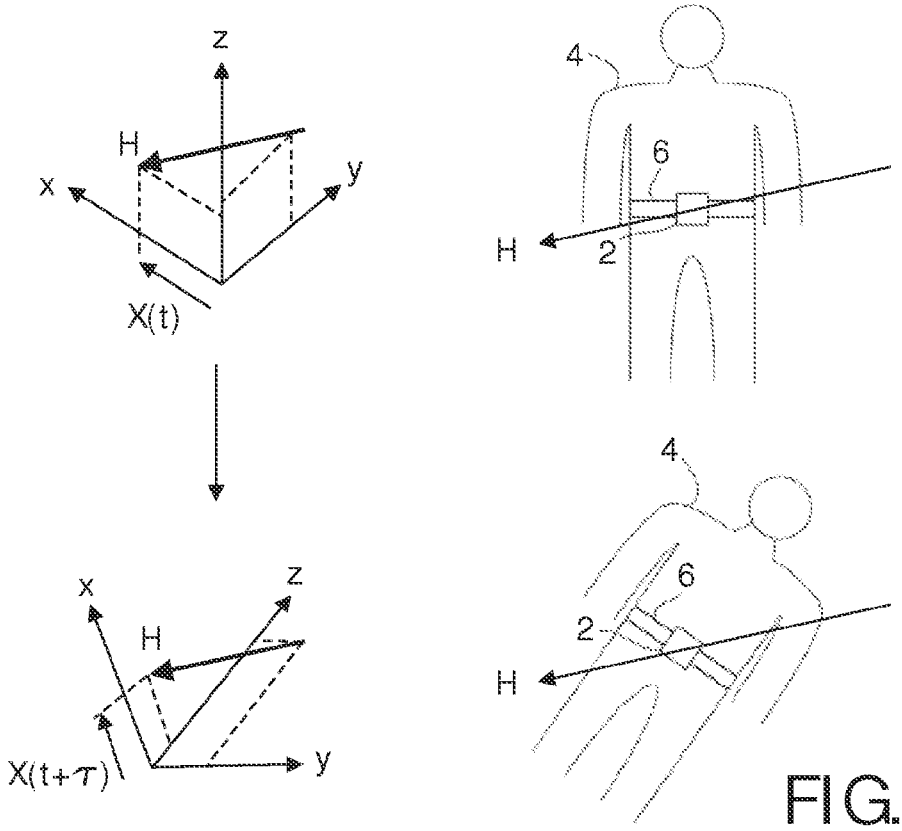
FIG. 6 illustrates a fall of a user wearing the fall detection system.

FIG. 6 illustrates a fall of a user 4 wearing the fall detection system 2. A magnetometer in the system 2 is used to measure a strength and/or direction of the magnetic field H in the vicinity of the fall detection system 2. In case of a drop or fall the one or more rotations of the fall detection system happen in a space of limited size where the magnetic field H is assumed to be homogeneous. There are various types of magnetometers known. For example a magnetometer may comprise one or more Hall effect sensors. By using three Hall effect sensors and positioning them orthogonally with respect to each other in a x-y-z co-ordinate system, a first sensor measuring the strength in an x-direction, a second sensor measuring the strength an y-direction and a third sensor measuring the strength in a z-direction the strength as well as the direction of the magnetic field H in the vicinity of the fall detection system 2 may be determined. When the magnetometer rotates the magnetic field strength measured by each one of the Hall effect sensors will change (unless the axis of rotation coincides with the x-axis, y-axis or z-axis, which is unlikely, and anyhow leaves the rotation to be measured with the magnetic field strength in the other two axes). A full rotation of the magnetometer may be detected by analyzing the orientation of the measured H field with respect to said magnetometer. However instead of analyzing the orientation of the H field in order to detect a full rotation it is also possible to analyze only for example the measured strength of the H field in the x-direction, X(t), in order to detect a rotation. This provides the advantage of a simpler analysis of a scalar X(t) in order to detect a rotation, for example by determining a periodicity in X(t). A rotation of the fall detection system 2 may therefore be detected with a magnetometer that is arranged to measure the strength of the magnetic field H only in a single direction, for example in the direction of the x-axis. In an embodiment of the fall detection system 2 the magnetometer comprises only one Hall sensor. In a further embodiment the magnetometer comprises two Hall sensors, oriented preferably orthogonally with respect to each other. This provides the advantage of enhanced sensitivity since even when the axis of rotation coincides with a measurement orientation (i.e. an x-direction or a y-direction) of one of the sensors the rotation of the fall detection system is detectable using the output signal of the other sensor.

Figure 7:
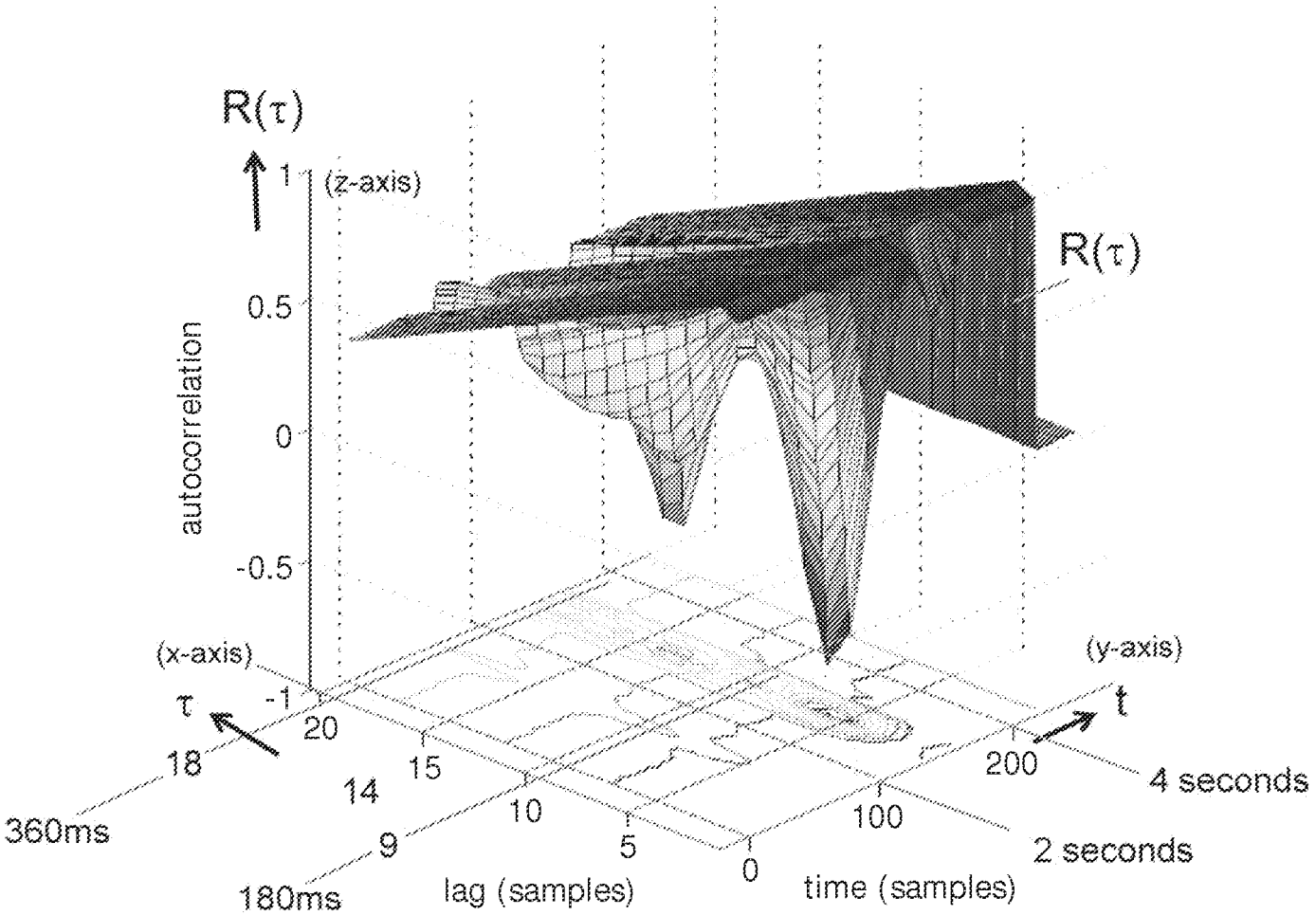
FIG. 7 shows a graph obtained with an algorithm in accordance with the invention.

FIG. 7 shows a graph obtained with an algorithm in accordance with the invention. A relatively simple way to detect a rotation is by determining the presence of a periodicity in the output signal of the magnetometer. It is an advantage that the periodicity of the rotation is also detectable in the scalar X(t) as discussed above under FIG. 6. The periodicity in the magnetometer's output signal may therefore be determined by computing an autocorrelation of the scalar X(t). For example an algorithm to determine the absence or presence of one or more full rotations comprises the steps of:

Sample the output signal X(t), for example with a frequency of 50 Hz, and store the samples in a memory;

Compute the auto correlation $R(\tau)=\int X(t)\cdot X(t+\tau)dt$ over a window of finite length, for example 500 ms, for various values of $\tau$, for example for $\tau$ in the range from one sample period (20 ms) up to 400 ms;

Repeat the computation of the previous step wherein the window is shifted one or more sample periods;

Determine the absence and presence of a peak value in the obtained values for $R(\tau)$, for a $\tau\neq 0$.

The result of performing the steps of the algorithm is shown in FIG. 7. The x-axis shows the values of $\tau$ expressed in unit samples. With a sample frequency of 50 Hz the sample period is 20 ms resulting in a shown range for $\tau$ of 0 to 400 ms. The y-axis shows time t, also expressed in unit samples resulting in a shown range for t of 0 to 4 seconds. The z-axis shows the computed autocorrelation $R(\tau)$. During the first two second (see y-axis) the fall detection system is in free fall without rotating leading to a high value for the autocorrelation. At 3 seconds a rotation happens as indicated by a periodicity in X(t). Said periodicity is leading to a peak in $R(\tau)$ at approximately 9 samples (see x-axis) and a second, weaker peak at approximately 18 samples, with the least values for autocorrelation in between at 6 and 14 samples lag. In an embodiment of the system the analyzing means are adapted to perform the steps of the algorithm discussed above.

In a further embodiment the analyzing means are adapted to compute an FFT (Fast Fourier Transform) of X(t) and to perform an analysis of X(t) in the frequency domain. A periodicity in X(t) caused by a rotation of the system shows up as a peak in the frequency spectrum of X(t). The analyzing means are further adapted to detect said peak. In a further embodiment the analyzing means are adapted to compute an FFT of $R(\tau)$. By transforming the autocorrelation to the frequency domain, the power spectrum is obtained as is known from the Wiener-Khinchine theorem. In the power spectrum the multiple peaks in $R(\tau)$ (as shown in FIG. 7 at approximately 9 and 18 samples) reinforce each other. The periodicity in X(t) caused by a rotation of the system appear in the spectrum as a peak (at $f_s/9$ Hz, $f_s$ being the sample frequency of 50 Hz). The analyzing means are further adapted to detect said peak in said spectrum.

The invention claimed is:

1. A fall detection system comprising:

one or more detectors that monitor movements of a user of the fall detection system, the one or more detectors including a magnetometer, an analysis element that is coupled to the one or more detectors and analyzes:

at least one output of at least of the one or more detectors to detect a potential fall of the user; and an output signal of the magnetometer to detect at least one full rotation of at least 360 degrees of the magnetometer, wherein, upon detecting the potential fall of the user, the analysis element causes an alarm element to:

issue an alarm when the at least one full rotation is not detected; and not issue the alarm when the at least one full rotation is detected.

2. The system of claim 1, wherein the analysis element analyzes the output signal of the magnetometer to detect the at least one full rotation in response to detecting the potential fall of the user.

3. The system of claim 1, wherein the one or more detectors include accelerometer coupled to the analysis element that provides an acceleration signal indicative of an acceleration of the system, wherein the analysis element analyzes the acceleration signal to detect the potential fall in response to the acceleration signal having exceeded a predetermined threshold value.

4. The system of claim 1, wherein the analysis element determines a periodicity of the output signal.

5. The system of claim 4, wherein the analysis element determines the periodicity using an autocorrelation function performed on the output signal of the magnetometer.

6. The system of claim 4, wherein the analysis element includes:

an analog to digital converter coupled to the magnetometer that converts the output signal to a plurality of digital codes, a memory coupled to the analog to digital converter that stores the plurality of digital codes, a processor coupled to the memory and arranged for retrieving the digital codes from the memory and further arranged for determining a periodicity of the output signal in dependence of the plurality of digital codes.

7. The system of claim 1, wherein the analysis element determines the periodicity using a Fast Fourier Transform (FFT) performed on the output signal of the magnetometer.

8. A method comprising:

analyzing, by a processing system, one or more sensor signals to identify a potential fall by a user of a fall detection system, analyzing, by the processing system, an output signal provided by a magnetometer of the fall detection system to detect the absence or presence of at least one full rotation of at least 360 degrees of the magnetometer, and in response to an identification of the potential fall:

providing, by the processing system, an alarm in the absence of the at least one full rotation; and preventing, by the processing system, the alarm in the presence of the at least one full rotation.

9. A method according to claim 8, wherein analyzing the output signal of the magnetometer is performed in response to the identification of the potential fall.

10. A method according to claim 8, wherein analyzing the output signal of the magnetometer includes determining a periodicity of the output signal.

11. A method according to claim 10, wherein the periodicity of the output signal is determined using autocorrelation performed on the output signal of the magnetometer.

12. The method of claim 10, wherein the periodicity of the output signal is determined using a Fast Fourier Transform (FFT) performed on the output signal of the magnetometer.

13. A method according to claim 8, wherein analyzing the one or more sensor signals includes analyzing an acceleration signal provided by an accelerometer comprised in the fall detection system.

14. A non-transitory computer-readable medium that includes a program that, when executed on a processor, causes the processor to: detect a potential fall by a user of a fall detection system, analyze an output signal provided by a magnetometer of the fall detection system to detect the absence or presence of at least one full rotation of at least 360 degrees of the magnetometer, and, in the event that the potential fall is defected and the at least one full rotation is not detected, the program causes the processor to issue an alarm, and in the event that the at least one full rotation is detected, the program prevents the processor from issuing the alarm.

15. The medium of claim 14, wherein the program causes the processor to detect the absence or presence of the at least one full rotation of the magnetometer by a process that includes applying an autocorrelation function to the output signal.

16. The medium of claim 14, wherein the program causes the processor to detect the absence or presence of the at least one full rotation of the magnetometer by a process that includes determining a periodicity of the output signal.

17. The medium of claim 14, wherein the program causes the processor to detect the potential fall by a process that includes analyzing an acceleration signal provided by an accelerometer.

18. The medium of claim 17, wherein the program causes the processor to analyze the output signal provided by the magnetometer only after the potential fall is detected by analyzing the acceleration signal.

19. The medium of claim 14, wherein the program causes the processor to detect the absence or presence of the at least one full rotation of the magnetometer by a process that includes applying a Fast Fourier Transform (FFT) to the output signal.

* * * * *